US005562076A

United States Patent [19]

Madl

[11] Patent Number: 5,562,076

[45] Date of Patent: Oct. 8, 1996

[54] RECIPROCATING PISTON ENGINE

[75] Inventor: Albert Madl, Stubenberg, Germany

[73] Assignee: Motorenfabrik Hatz-GmbH & Co. KG, Ruhstorf/Rott, Germany

[21] Appl. No.: 531,691

[22] Filed: Aug. 23, 1995

Related U.S. Application Data

[63] Continuation of PCT/EP94/00500, Feb. 2, 1994.

[30] Foreign Application Priority Data

Feb. 23, 1993 [DE] Germany ..... 43 05 484.6

[51] Int. Cl.[6] ..... F02M 35/08

[52] U.S. Cl. ..... 123/198 E; 73/118.2

[58] Field of Search ..... 123/198 E; 73/118.2

[56] References Cited

U.S. PATENT DOCUMENTS

| | | | |
|---|---|---|---|
| 4,445,368 | 5/1984 | Sumal | 73/118.1 |
| 4,577,495 | 3/1986 | Bamer | 73/118 |
| 4,930,472 | 6/1990 | Ozaki | 123/198 E |
| 5,369,990 | 12/1994 | Zurek et al. | 73/118.2 |

FOREIGN PATENT DOCUMENTS

| | | | |
|---|---|---|---|
| 1203045 | 10/1965 | Germany . | |
| 63-243429 | 10/1988 | Japan | 123/198 E |
| 63-295851 | 12/1988 | Japan . | |
| 64-348 | 1/1989 | Japan . | |
| 1-163457 | 6/1989 | Japan . | |
| 3-67040 | 3/1991 | Japan | 123/198 E |
| WO94/19595 | 9/1994 | WIPO | 123/198 E |

*Primary Examiner*—David A. Okonsky
*Attorney, Agent, or Firm*—Helfgott & Karas, P G

[57] ABSTRACT

A reciprocating piston engine, in particular a single-cylinder Diesel engine (2), has an air filter (1) in the suction pipe (3). To service the same, a pressure gauge (13) is arranged downstream of the filter cartridge (7), in the direction of flow. A check valve is provided at the measurement site or in the measurement pipe (12) between the measurement site and the pressure gauge (13).

4 Claims, 1 Drawing Sheet

RECIPROCATING PISTON ENGINE

Figure 1:
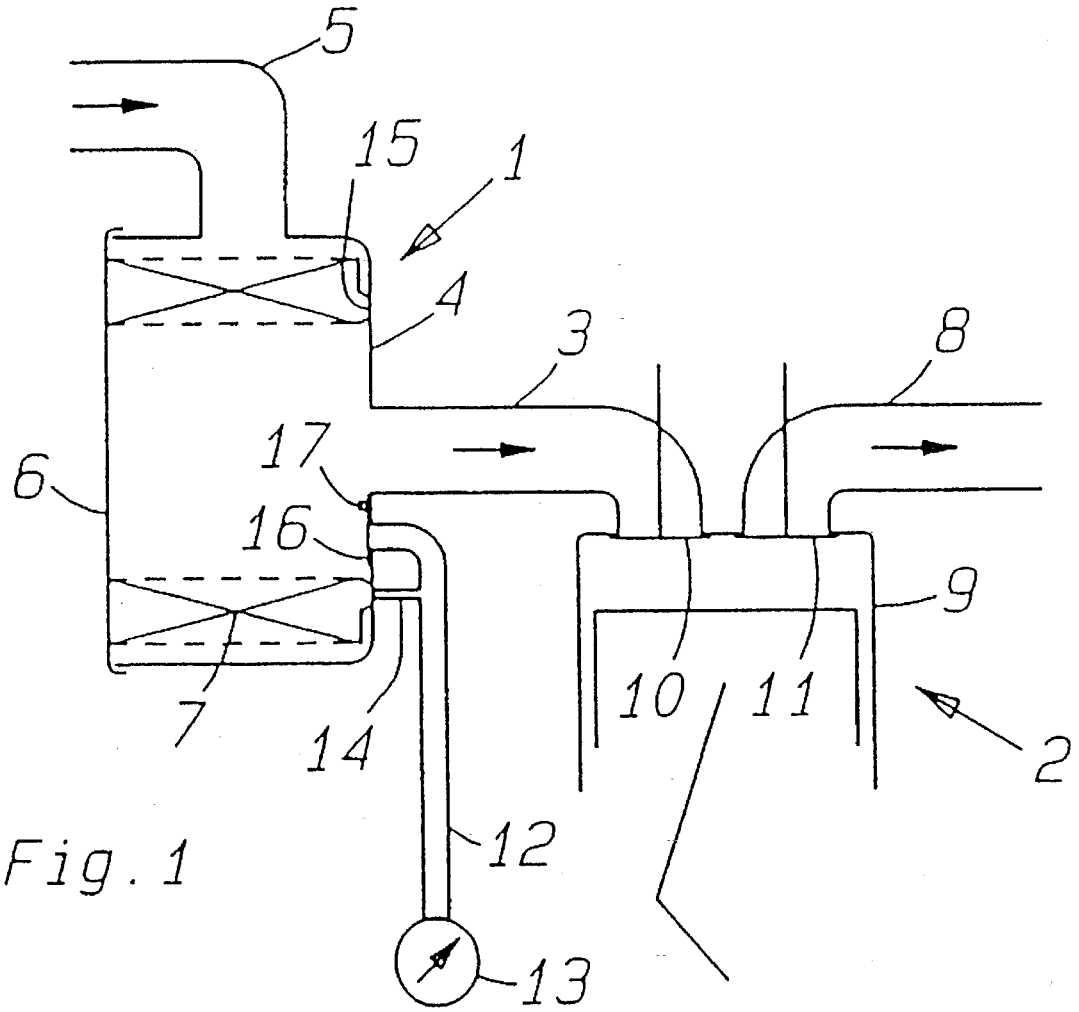

This is a continuation of application Ser. No. PCT/EP94/00500 filed on Feb. 22, 1994.

The invention relates to a reciprocating piston engine, particularly to a single cylinder diesel engine with an air filter in the suction line, for the maintenance of which a pressure-measuring instrument is provided downstream from the filter insert in the direction of flow.

Conventional, commercially obtainable pressure-measuring instruments, which are used as a maintenance indicator for dry-air filters, react to the flow resistance of the dry filter, in that they indicate the average reduced pressure, which gradually increases in the interior of the filter as a consequence of the dirt accumulated in it.

Particularly when such pressure-measuring instruments are used for air filters of single cylinder diesel engines, it turns out that a reliable indication of the reduced pressure cannot be expected. In the case of mechanical maintenance indicators, an erratic signal is observed, which is due to the pulsation of the air coming into the filter housing and can no longer be read unambiguously, with electrical maintenance switches also, a signal is obtained, which cannot be used. Only after a degree of dirt accumulation is reached, which lies clearly above the maximum permissible value, do the conventional, commercial maintenance indicators give an unambiguous deflection, in that they indicate the exchanging of the filter insert. This unambiguous deflection means that the average reduced pressure has already assumed too large a value. In this state, the dirt accumulation, which appropriately is measured by the reduced pressure peaks of the corresponding pressure oscillation, has thus increased beyond the permissible extent, that is, for practical purposes the filter insert is exchanged too late.

The JP-A-163457 relates to the damping of gas-pressure pulsations in connection with the indication of the degree of dirt accumulation of a filter element. On the input side of the indicator, a check valve is used as damping element, which generates a smoothened average value of the reduced pressure. When a certain reduced pressure is reached, an electrical switch is actuated in the indicator.

It is an object of the present invention to provide for a reciprocating piston engine of the type named above a maintenance indicator for air filters, which reacts selectively to reduced pressure peaks even under the influence of strong pressure pulsations, so that the prompt exchange of the filter insert is ensured. Moreover, it shall be possible to continue using conventional commercial pressure-measuring indicators or maintenance indicators.

Pursuant to the invention, this objective is accomplished owing to the fact that the measurement site is formed by the outlet of the measurement line in the filter housing and that in the interior of the filter housing a measurement lamella is disposed, which covers the opening of the outlet and closes off or opens up the opening of the outlet as a function of the reduced pressure in the filter housing in such a manner, that the reduced pressure in the measurement line increases continuously between the measurement site and the measurement instrument.

By means of such a measuring lamella with attached measurement line, there is a sufficiently accurate indication of the pressure in the form of a smoothened course of the reduced pressure peaks; at the same time, it is possible to use a conventional commercial maintenance indicator.

Advisably the measurement: lamella is pretensioned slightly elastically against the opening of the outlet, for which purpose a slight curvature of the lamella can be utilized, which is introduced by the manufacturing process. At the same time, the recorded reduced pressure values must first overcome the selected slight pretension, before they can be indicated. Appropriate pressure-measuring instruments react to the resulting, clear signal values with an unambiguous display and, moreover, even when the air stream is subjected to particularly strong pulsations, as in the case of the single cylinder diesel engine.

Preferably, the measurement lamella consists of a rubber-like material, such as silicone. Such a measuring lamella has the advantage that it brings about automatic venting of the measurement line, so that resetting of the measuring instrument is ensured after an exchange of filters by actuating a resetting knob, which is usually present.

According to a further proposal of the invention, the venting of the measurement line can also be ensured owing to the fact that, in addition, a bypass line is provided, which connects the filter housing with the measurement line and which is closed off by a filter insert, preferably a sealing lip, while the engine is running. There is thus automatic venting of the measurement line when the filter insert is exchanged.

Figure 1A:
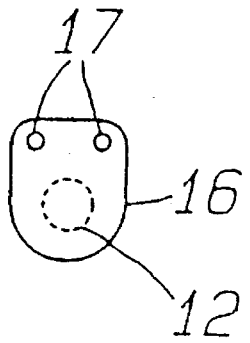

In the following, an embodiment of the invention is explained by means of the drawing, in which, in each case in diagrammatic representation, FIG. 1 shows a maintenance indicator connected to the filter housing of a diesel engine and FIG. 1*a* shows a detail view of FIG. 1.

The drawing shows an air filter 1 on a single cylinder diesel engine 2, which are connected together over a suction line 3. The air filter 1 consists of a filter housing 4 with an air inlet line 5 and a removable cover 6 for exchanging the dirty filter insert 1, which is shown in the form of a ring-shaped dry air filter insert. The arrows indicate the direction of flow in the individual lines, the exhaust gas line 8 from cylinder 9 of the engine 2 also being drawn, The inlet valve 10 and the outlet valve 11 are also shown diagrammatically. The measurement line 12, which leads to a pressure-measuring instrument 13, is connected with the filter housing 4. A bypass line 14 ensures that the measurement line 12 is vented when the filter insert 7 is exchanged. While the engine is running or: as long as the filter insert is in place in the filter housing, the bypass line 14 is closed off by the filter insert 7 itself, for example, in that the filter insert 7 has a sealing ring surface 15 at the level of the connecting site of the bypass line 14.

According to FIG. 1, a measuring lamella 16 is fastened movably by means of screws 17 in the interior of the filter housing 4 in front of the opening of the measurement line 12 (compare FIG. 1*a*). As a result of the air pulsations in the interior of the filter housing, which are particularly pronounced in the case of a single cylinder diesel engine, the measuring lamella 16, seated by suction on the outlet of the measuring line 12, is lifted slightly from the outlet of the measurement line 12 by the reduced pressured peaks occurring while the engine is running, the value of the reduced pressure, responsible for this, being indicated in the pressure measuring instrument 13. The measuring lamella 16 causes the reduced pressure peaks to be convened into a smoothened signal value, which can be indicated unambiguously by the pressure measuring instrument 13. In a practical example, the pressure measuring instrument can be adjusted so that its display begins to release a red field for exchanging the filter insert from $-2{,}000\ N/m^2$ ($-200$ mm pressure in units of water height) onwards up to $-3{,}500\ N/m^2$ ($-350$ mm pressure in units of water height). At the last-mentioned value, there is usually a mechanical locking of the maintenance indicator, which makes it necessary to actuate a resetting knob when the filter is exchanged. A bypass line 14 serves to vent the measurement line 12, thus ensuring that the reduced pressure, present in the measurement line and in the pressure measuring instrument, is dissipated during the exchange of filters and the maintenance indicator (red field) is reset after the reset knob is actuated.

I claim:

1. A reciprocating piston engine, particularly a single cylinder diesel engine (2) with an air filter (1) in the suction line (3), for the maintenance of which a pressure measuring device (13) is provided downstream from the filter insert (7) in the direction of flow, characterized in that the measurement site is formed by the outlet of the measurement line (12) in the filter housing (4) and that, in the interior of the filter housing (4), a measuring lamella (16) is disposed, which covers the opening of the outlet and closes off or releases the opening of the outlet as a function of the reduced pressure in the filter housing (4) in such a manner, that the reduced pressure in the measurement line (12) constantly increases between the measurement site and the measuring instrument (13).

2. The reciprocating piston engine of claim 1, characterized in that the measurement lamella (16) is pretensioned slightly elastically against the outlet of the opening.

3. The reciprocating piston engine of claim 2, characterized in that the measurement lamella (16) consist of a rubber-like material.

4. The reciprocating piston engine of claim 1, characterized in that, in addition, a bypass line (14) is provided, which connects the filter housing (4) with the measurement line (12) and which is closed off by the filter insert (7) while the engine is running.

* * * * *